US011338345B2

(12) United States Patent
Zheng et al.

(10) Patent No.: US 11,338,345 B2
(45) Date of Patent: May 24, 2022

(54) METHOD FOR FORMING TUBE WITH HIGH INTERNAL PRESSURE AND LOW EXTERNAL PRESSURE, AND FORMING MACHINE

(71) Applicant: BAOLONG (ANHUI) AUTO PARTS CO., LTD, Ningguo (CN)

(72) Inventors: Yuqing Zheng, Ningguo (CN); Xulin Chen, Ningguo (CN); Yulei Zheng, Ningguo (CN); Shaoming Chen, Ningguo (CN); Xiaobo Deng, Ningguo (CN); Jie Yang, Ningguo (CN); Yan Xu, Ningguo (CN)

(73) Assignee: BAOLONG (ANHUI) AUTO PARTS CO., LTD, Ningguo (CN)

( * ) Notice: Subject to any disclaimer, the term of this patent is extended or adjusted under 35 U.S.C. 154(b) by 16 days.

(21) Appl. No.: 17/048,519

(22) PCT Filed: Feb. 15, 2019

(86) PCT No.: PCT/CN2019/075172

§ 371 (c)(1),
(2) Date: Oct. 16, 2020

(87) PCT Pub. No.: WO2019/201009

PCT Pub. Date: Oct. 24, 2019

(65) Prior Publication Data

US 2021/0170470 A1 Jun. 10, 2021

(30) Foreign Application Priority Data

Apr. 18, 2018 (CN) ..... 201810348914.5

(51) Int. Cl.
*B21D 26/033* (2011.01)
*B21D 26/047* (2011.01)
*B21D 26/041* (2011.01)

(52) U.S. Cl.
CPC ..... *B21D 26/033* (2013.01)

(58) Field of Classification Search
CPC .. B21D 26/033; B21D 26/047; B21D 26/041; B21D 26/039; B21D 26/043; B21D 26/045; Y10T 29/49805
See application file for complete search history.

(56) References Cited

U.S. PATENT DOCUMENTS 6,128,936 A * 10/2000 Yogo
6,802,196 B2 * 10/2004 Gong ..... B21D 26/041 72/58

(Continued)

FOREIGN PATENT DOCUMENTS

CN 102274886 12/2011
CN 102921792 2/2013

(Continued)

OTHER PUBLICATIONS

English translate (CN 104226779A), retrieved date Feb. 25, 2022.*

(Continued)

*Primary Examiner* — Jessica Cahill
*Assistant Examiner* — Mohammed S. Alawadi
(74) *Attorney, Agent, or Firm* — Hamre, Schumann, Mueller & Larson, P.C.

(57) ABSTRACT

Disclosed is a method for forming a tube with high internal pressure and low external pressure. The method comprises: putting a tube to be formed into a cavity, such that a bulging area (15) is formed between the tube to be formed and an inner wall of the cavity; continuously injecting a low-pressure fluid into the bulging area, and then injecting a high-pressure fluid into the interior of the tube to be formed, the high-pressure fluid creating a pressure on an outer wall of the tube to be formed such that the tube to be formed starts to expand to the bulging area; stopping the supply of the (Continued)

low-pressure fluid when the tube is bulged to conform to the inner wall of the cavity; and taking the formed tube out to complete a working cycle. Further disclosed is a forming machine for forming a tube according to the above method. According to the machine for forming a tube with high internal pressure and low external pressure, a mold body (1) is provided with a first through hole (13) and a second through hole (14) for circulating a low-pressure fluid into and out of a bulging area, so as to create a certain pressure P1 on the tube and ensure uniform bulging of the entire tube, thereby achieving a better forming effect.

10 Claims, 2 Drawing Sheets

(56) References Cited

U.S. PATENT DOCUMENTS

| | | | | |
|---|---|---|---|---|
| 8,281,630 | B2 * | 10/2012 | Mizumura | B21D 26/033 72/58 |
| 8,297,096 | B2 * | 10/2012 | Mizumura | B21D 22/025 72/58 |
| 2001/0005929 | A1 * | 7/2001 | Streubel | |
| 2011/0097596 | A1 * | 4/2011 | Mizumura | B21D 26/041 428/603 |
| 2013/0167607 | A1 * | 7/2013 | Adams | B21D 51/2669 72/61 |
| 2015/0040399 | A1 * | 2/2015 | Dennis | |
| 2017/0095854 | A1 * | 4/2017 | Ishizuka | B21D 22/12 |
| 2017/0120317 | A1 * | 5/2017 | Ishizuka | |
| 2018/0078988 | A1 * | 3/2018 | Ishizuka | B21D 26/047 |
| 2018/0361458 | A1 * | 12/2018 | Ishizuka | B21D 19/08 |
| 2019/0161819 | A1 * | 5/2019 | Werbs | B21D 26/033 |

FOREIGN PATENT DOCUMENTS

| | | |
|---|---|---|
| CN | 103272910 | 9/2013 |
| CN | 103920788 | 7/2014 |
| CN | 104226779 | 12/2014 |
| CN | 104226779 A | * 12/2014 |
| CN | 108526284 | 9/2018 |

OTHER PUBLICATIONS

International Search Report issued for International Patent Application No. PCT/CN2019/075172, dated May 29, 2019, 7 pages including English translation.

* cited by examiner

METHOD FOR FORMING TUBE WITH HIGH INTERNAL PRESSURE AND LOW EXTERNAL PRESSURE, AND FORMING MACHINE

TECHNICAL FIELD

The invention relates to the technical field of tube production equipment, in particular to a method for forming tube with high internal pressure and low external pressure, and a forming machine.

BACKGROUND ART

Currently, hot-end tubes (connecting tubes between vehicle engines and exhaust pipes) and vehicle body structural members (vehicle floor supports, transverse and longitudinal beams, instrument beams, etc.) are mostly produced by high-internal-pressure forming processes, that is, by injecting high-pressure water into a tube and performing feeding by left and right side cylinders, such that the product is bulged to the desired shape. The product of the hot-end tube generally has a relatively large change in cross-sectional area, that is, the amount of local bulging is very large, and the bulging area is prone to cracking. Conventional processes are to perform multiple time of annealing and multiple times of forming to meet the forming requirements. The specific process is: first annealing, first forming, second annealing, and second forming. The internal pressure during the first forming must be set to a relatively small value, generally 20-30 MPa, to ensure that a tubing is preformed once without cracking, the forming stress caused by the first forming is eliminated by the second annealing, and the product is bulged to the form of a mathematical model during the second forming Common high-internal-pressure forming has the following disadvantages:

1. it is likely to produce cracks during forming, the scrap rate is high, and the requirements for weld quality are high;
2. in order to reduce the cracking rate during forming, it is necessary to perform multiple times of annealing to eliminate the forming stress, and perform multiple times of forming to meet the processing requirements, so that this process has large energy consumption, increased number of required equipment items and high processing costs;
3. due to the influence of factors such as raw material properties, first forming pressure and annealing process during the first forming, the size of the product after the first forming cannot be effectively controlled, which will affect the secondary forming; and
4. there are many process flows, the difficulty of process quality control increases, and the cost increases.

SUMMARY OF THE INVENTION

In order to solve the technical problems existing in the background art, the present invention proposes a method for forming a tube with high internal pressure and low external pressure, and a forming machine.

The method for forming a tube with high internal pressure and low external pressure proposed in the present invention comprises the following steps:

S1. putting a tube to be formed into a cavity, a bulging area being formed between the tube to be formed and an inner wall of the cavity, a mold being provided with a first through hole and a second through hole, continuously injecting a low-pressure fluid into the bulging area through the first through hole, and discharging the low-pressure fluid through the second through hole, such that the bulging area is always kept in a state of being filled with the low-pressure fluid, wherein a pressure created by the low-pressure fluid on an outer wall of the tube to be formed is P1, a deformation pressure threshold of the tube to be formed is P2, and P1<P2;

S2. sealing two ends of the tube to be formed, and continuously injecting a high-pressure fluid into the tube to be formed by means of a pressure booster, the high-pressure fluid creating a pressure on the outer wall of the tube to be formed;

S3. increasing the pressure of the high-pressure fluid on the outer wall of the tube to be formed to a first pressure threshold P3, wherein P3>P1+P2, such that the tube to be formed starts to expand to the bulging area, and the bulging area gradually decreases;

S4. stopping the supply of the low-pressure fluid when the tube is bulged to conform to the inner wall of the cavity;

S5. continuing to increase the pressure of the high-pressure fluid on the outer wall of the tube to a second pressure threshold P4, wherein P4>P3, such that the tube completely conforms to the inner wall of the cavity to empty the low-pressure fluid from the bulging area; and S6. returning the high-pressure fluid to the pressure booster, opening the mold, and taking the formed tube out to complete a work cycle.

Preferably, P1 remains constant.

Preferably, in S2, the two ends of the tube to be formed are sealed by a piston rod of a first side cylinder and a piston rod of a second side cylinder; and in S3, S4 and S5, the piston rod of the first side cylinder and the piston rod of the second side cylinder move toward the middle of the tube to be formed.

Preferably, in S6, the piston rod of the first side cylinder and the piston rod of the second side cylinder withdraw from the tube.

The method for forming a tube with high internal pressure and low external pressure proposed in the present invention is to inject a low-pressure fluid between an outer wall of the tube to be formed and an inner wall of a cavity, the low-pressure fluid applies a dynamic and stable pressure P1 to the tube to be formed such that the outer wall of the tube has a relatively stable flexible support during the bulging process, and pressures P1 received by the tube in a circumferential direction are equal, which can ensure that the tube can expand evenly during the bulging process without cracking. The low-pressure fluid also has the effect of lubricating the tube, and can improve the stretching effect of the tube. Moreover, the number of forming process flows is small, one forming is enough, and there is no need to take out the tube and put it back multiple times, so that the processing cost is also reduced.

The present invention further proposes a machine for forming a tube with high internal pressure and low external pressure, comprising a mold body, a first side cylinder, a second side cylinder, a low-pressure fluid supply circuit and a high-pressure fluid supply passage, wherein the mold body is internally provided with a cavity for placing a tube, the cavity penetrates the mold body and comprises a bulging section and a clamping section which are in communication with each other, the mold body is further provided with at least one first through hole in communication with the bulging section and at least one second through hole in communication with the bulging section, and the clamping section is configured to fix the tube, and a piston rod of the first side cylinder and a piston rod of the second side cylinder are configured to seal two ends of the tube;

the low-pressure fluid supply circuit comprises an inflow passage and a return passage, the inflow passage is in communication with the first through hole for driving a low-pressure fluid into the bulging section, and the return passage is in communication with the second through hole for allowing the low-pressure fluid to be discharged from the bulging section; and the high-pressure fluid supply passage is in communication with the interior of the tube for delivering a high-pressure fluid to the interior of the tube.

Preferably, the inflow passage comprises a low-pressure fluid driving device, a first overflow valve and an inflow pipeline, the fluid driving device and the first overflow valve are installed on the inflow pipeline, and the inflow pipeline is in communication with the first through hole; and the return passage comprises a return pipeline and a second overflow valve, the return pipeline is in communication with the second through hole, and the second overflow valve is installed on the return pipeline.

Preferably, a preset first opening pressure of the first overflow valve is P5, a preset second opening pressure of the second overflow valve is P6, and P5=P6.

Preferably, the high-pressure fluid supply passage comprises a high-pressure fluid driving device, a pressure booster, and a high-pressure fluid pipeline, the high-pressure fluid driving device and the pressure booster are installed on the high-pressure fluid pipeline, and the high-pressure fluid pipeline is in communication with the tube to be formed.

Preferably, the piston rod of the second side cylinder is provided with a penetrating hole, a first end of the penetrating hole is positioned on an end face of the piston rod, a second end of the penetrating hole is positioned on a side wall of the piston rod, and the high-pressure fluid pipeline is connected to the second end of the penetrating hole.

Preferably, the high-pressure fluid and the low-pressure fluid may be one of water, oil, air, and nitrogen.

According to the machine for forming a tube with high internal pressure and low external pressure proposed in the present invention, a mold is provided with a first through hole and a second through hole for circulating a low-pressure fluid into and out of a bulging area so as to create a certain pressure P1 on the tube, and a low-pressure fluid supply circuit is provided with a first overflow valve and a second overflow valve which are used to control the pressure P1 in the bulging area to keep constant, so as to ensure uniform bulging of the entire tube, thereby achieving a better forming effect.

BRIEF DESCRIPTION OF THE DRAWINGS

The features and properties of the present invention are further described by the following embodiments and the drawings thereof.

DETAILED DESCRIPTION OF PREFERRED EMBODIMENTS

Figure 1:
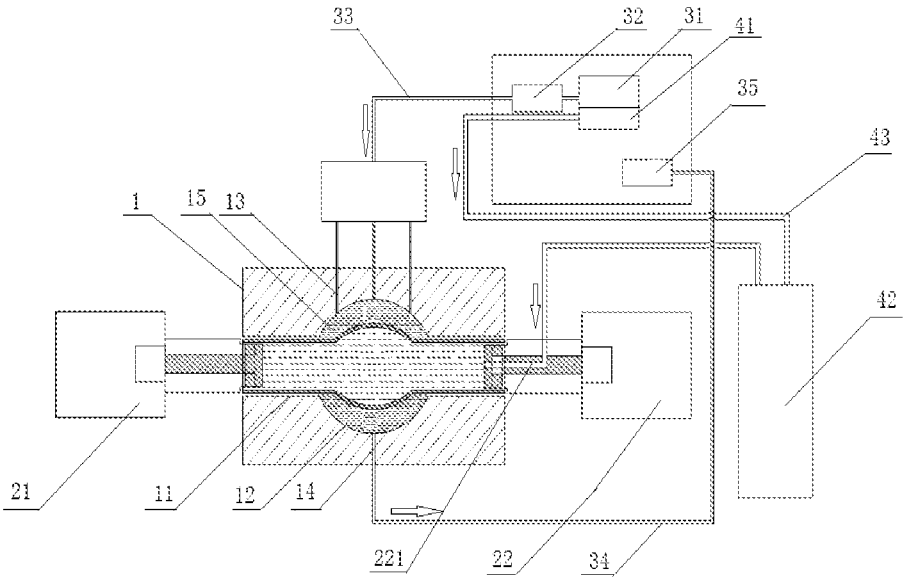
FIG. 1 is a schematic structural diagram of a machine for forming a tube with high internal pressure and low external pressure proposed in the present invention.
Figure 2:
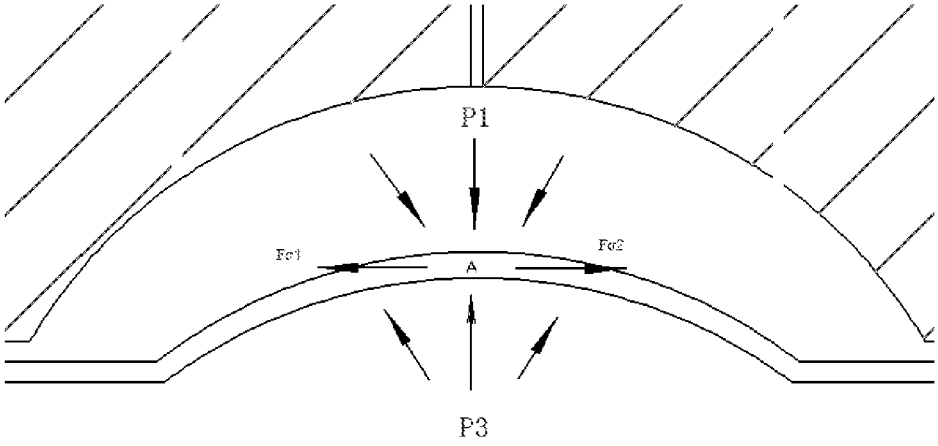
FIG. 2 is a schematic diagram showing a method for forming a tube with high internal pressure and low external pressure proposed in the present invention and the stress analysis of the forming machine under a working condition.

As shown in FIGS. 1 and 2, FIG. 1 is a schematic structural diagram of a machine for forming a tube with high internal pressure and low external pressure proposed in the present invention; and FIG. 2 is a schematic diagram showing a method for forming a tube with high internal pressure and low external pressure proposed in the present invention and the stress analysis of the forming machine under a working condition.

Referring to FIG. 1, the method for forming a tube with high internal pressure and low external pressure proposed in the present invention comprises the following steps:

S1. putting a tube to be formed into a cavity, a bulging area 15 being formed between the tube to be formed and an inner wall of the cavity, a mold being provided with a first through hole 13 and a second through hole 14, continuously injecting a low-pressure fluid into the bulging area 15 through the first through hole 13, and discharging the low-pressure fluid through the second through hole 14, such that the bulging area 15 is always kept in a state of being filled with the low-pressure fluid, wherein a pressure created by the low-pressure fluid on an outer wall of the tube to be formed is P1, a deformation pressure threshold of the tube to be formed is P2, P1<P2, and P1 is 15 MPa in this embodiment;

S2. sealing two ends of the tube to be formed, and continuously injecting a high-pressure fluid into the tube to be formed by means of a pressure booster 42, the high-pressure fluid creating a pressure on the outer wall of the tube to be formed;

S3. increasing the pressure of the high-pressure fluid on the outer wall of the tube to be formed to a first pressure threshold P3, wherein P3>P1+P2, such that the tube to be formed starts to expand to the bulging area 15, and the bulging area 15 gradually decreases;

S4. stopping the supply of the low-pressure fluid when the tube is bulged to conform to but is not completely pressed against the inner wall of the cavity;

S5. continuing to increase the pressure of the high-pressure fluid on the outer wall of the tube to a second pressure threshold P4, wherein P4 is 100 MPa in this embodiment and P4>P3, such that the tube completely conforms to and is pressed against the inner wall of the cavity, and the tube is completely expanded to empty the low-pressure fluid from the bulging area 15; and S6. returning the high-pressure fluid to the pressure booster 42, opening the mold, and taking the formed tube out to complete a work cycle.

In order to better achieve the forming effect, in this embodiment, P1 is kept constant during the bulging process to maintain uniform expansion throughout the tube.

In S2, the two ends of the tube to be formed are sealed by a piston rod of a first side cylinder 21 and a piston rod of a second side cylinder 22 to prevent the high-pressure fluid from leaking out of the tube. In S3, S4 and S5, the piston rod of the first side cylinder 21 and the piston rod of the second side cylinder 22 move toward the middle of the tube to be formed, to increase the pressure of the high-pressure fluid on the inner wall of the tube and increase the forming speed. In S6, the piston rod of the first side cylinder 21 and the piston rod of the second side cylinder 22 withdraw from the tube.

Referring to FIG. 1, the present invention proposes a machine for forming a tube with high internal pressure and low external pressure, comprising a mold body 1, a first side cylinder 21, a second side cylinder 22, a low-pressure fluid supply circuit and a high-pressure fluid supply passage.

The mold body 1 comprises an upper mold and a lower mold. In a mold closed state, the upper mold and the lower mold enclose a cavity for placing the tube. The cavity penetrates the mold body 1, and comprises a bulging section 12 and a clamping section 11 which are in communication with each other. The bulging section 12 allows the tube to be bulged to form the desired shape. The clamping section 11 is used to clamp the tube. After the tube is placed into the cavity, the two ends of the tube abut against an inner wall of the clamping section 11 to form sealed connections. The middle of the tube and the inner wall of the bulging section 12 form a bulging area 15. The upper mold is provided with three first through holes 13 in communication with the bulging section 12. The first through holes 13 allow a low-pressure fluid to enter the bulging area 15. The lower mold is provided with one second through hole 14 in communication with the bulging section 12. The second through hole 14 allows the low-pressure fluid in the bulging area 15 to be discharged therefrom. A piston rod of the first side cylinder 21 and a piston rod of the second side cylinder 22 are used to seal the two ends of the tube, and the two piston rods can move in the tube in an axial direction of the tube.

The low-pressure fluid supply circuit comprises an inflow passage and a return passage. The inflow passage is in communication with the first through holes 13 for driving the low-pressure fluid into the bulging section 12. The inflow passage comprises a low-pressure fluid driving device 31, a first overflow valve 32 and an inflow pipeline 33. In this embodiment, the low-pressure fluid driving device 31 is a hydraulic pump, and the low-pressure fluid is water. The hydraulic pump and the overflow valve are installed on the inflow pipeline 33, the inflow pipeline 33 is in communication with the first through holes 13, and the hydraulic pump pumps the water from a water tank into the bulging area 15. The return passage is in communication with the second through hole 14 for allowing the low-pressure fluid to be discharged from the bulging section 12. The return passage comprises a return pipeline 34 and a second overflow valve 35, the return pipeline 34 is in communication with the second through hole 14, the second overflow valve 35 is installed on the return pipeline 34, and an outlet of the return pipeline 34 is in communication with the water tank, such that the water in the bulging area 15 is returned to the interior of the water tank.

The high-pressure fluid supply passage is configured to be in communication with the interior of the tube for delivering a high-pressure fluid to the interior of the tube. The high-pressure fluid supply passage comprises a high-pressure fluid driving device 41, a pressure booster 42, and a high-pressure fluid pipeline 43. The high-pressure fluid driving device 41 in this embodiment is a hydraulic pump. The hydraulic pump and the pressure booster 42 are installed on the high-pressure fluid pipeline 43, the high-pressure fluid pipeline 43 is in communication with the interior of the tube to be formed, and the hydraulic pump pumps the water from the water tank into the tube.

The function of the overflow valves in this embodiment is to maintain the pressure applied by the water in the bulging area 15 to the tube always constant. In this embodiment, a preset first opening pressure of the first overflow valve 32 is P5, a preset second opening pressure of the second overflow valve 35 is P6, and P5=P6.

In the design of the high-pressure fluid pipe 43 in communication with the interior of the tube, the piston rod of the second side cylinder 22 is provided with a penetrating hole 221, a first end of the penetrating hole 221 is positioned on an end face of the piston rod, a second end of the penetrating hole 221 is positioned on a side wall of the piston rod, and the high-pressure fluid pipeline 43 is in communication with the penetrating hole 221.

In the specific working process of the machine for forming a tube with high internal pressure and low external pressure of this embodiment, the tube is first put into the cavity, the low-pressure driving device continuously pumps the water from the water tank into the bulging area 15 through the first overflow valve 32, and the water then returns to the water tank through the second overflow valve 35. The first side cylinder 21 and the second side cylinder 22 seal the two ends of the tube. The high-pressure driving device drives the water into the tube to fill the interior of the tube with water. The pressure booster 42 works. At this time, the high-pressure driving device stops working and starts to apply pressure to the tube to deform the tube and finally obtain the desired shape. After the forming is completed, the pressure booster 42 and the low-pressure fluid driving device 31 stop working. The mold is opened and the formed part is taken out, and a working cycle is completed.

The stress condition of the bulging area during the bulging process is shown in FIG. 2. A point A of the tube is respectively subjected to a pressure P3 of the high-pressure fluid on the inner wall of the tube to be formed and a pressure P1 of the low-pressure fluid on the outer wall of the tube to be formed. Under the action of P3, the point A is subjected to stresses Fσ1 and Fσ2 in circumferential tangential directions, and the stresses Fσ1 and Fσ2 are the forces that directly cause the tubing to crack during forming Under the action of P1, component forces in a circumferential tangent line are just opposite to Fσ1 and Fσ2, and can be offset with Fσ1 and Fσ2, such that the material can flow uniformly during the bulging of the tubing, thereby avoiding cracking during the tube bulging process.

The foregoing description is merely illustrative of preferred embodiments of the present invention, but the scope of protection of the present invention is not limited thereto. Equivalent replacements or modifications made to the technical solutions and the inventive concept of the present invention by those skilled in the art within the technical scope of the disclosure of the present invention fall into the scope of protection of the present invention.

The invention claimed is:

1. A method for forming a tube with high internal pressure and low external pressure, comprising the following steps:

S1. putting a tube to be formed into a cavity, a bulging area being formed between the tube to be formed and an inner wall of the cavity, a mold body being provided with a first through hole and a second through hole, continuously injecting a low-pressure fluid into the bulging area through the first through hole, and discharging the low-pressure fluid through the second through hole, such that the bulging area is always kept in a state of being filled with the low-pressure fluid, wherein a pressure created by the low-pressure fluid on an outer wall of the tube to be formed is P1, a deformation pressure threshold of the tube to be formed is P2, and P1<P2;

S2. sealing two ends of the tube to be formed, and continuously injecting a high-pressure fluid into the tube to be formed by means of a pressure booster, the high-pressure fluid creating a pressure on the outer wall of the tube to be formed;

S3. increasing the pressure of the high-pressure fluid on the outer wall of the tube to be formed to a first pressure threshold P3, wherein P3>P1+P2, such that the tube to be formed starts to expand to the bulging area, and the bulging area gradually decreases;

S4. stopping the supply of the low-pressure fluid when the tube is bulged to conform to the inner wall of the cavity;

S5. continuing to increase the pressure of the high-pressure fluid on the outer wall of the tube to a second pressure threshold P4, wherein P4>P3, such that the tube completely conforms to the inner wall of the cavity to empty the low-pressure fluid from the bulging area; and S6. returning the high-pressure fluid to the pressure booster, opening the mold body, and taking the formed tube out to complete a work cycle.

2. The method for forming a tube with high internal pressure and low external pressure according to claim 1, wherein P1 remains constant.

3. The method for forming a tube with high internal pressure and low external pressure according to claim 1, wherein in S2, the two ends of the tube to be formed are sealed by a piston rod of a first side cylinder and a piston rod of a second side cylinder; and in S3, S4 and S5, the piston rod of the first side cylinder and the piston rod of the second side cylinder move toward the middle of the tube to be formed.

4. The method for forming a tube with high internal pressure and low external pressure according to claim 3, wherein in S6, the piston rod of the first side cylinder and the piston rod of the second side cylinder withdraw from the tube.

5. A forming machine with high internal pressure and low external pressure for implementing a method for forming a tube with high internal pressure and low external pressure according to claim 1, the forming machine comprising a mold body, a first side cylinder, a second side cylinder, a low-pressure fluid supply circuit and a high-pressure fluid supply passage, wherein the mold body is internally provided with a cavity for placing a tube, a bulging area being formed between the tube and an inner wall of the cavity, the cavity penetrates the mold body and comprises a bulging section and a clamping section which are in communication with each other, the mold body is provided with at least one first through hole in communication with the bulging section and at least one second through hole in communication with the bulging section, and the clamping section is configured to fix the tube, and a piston rod of the first side cylinder and a piston rod of the second side cylinder are configured to seal two ends of the tube;

the low-pressure fluid supply circuit comprises an inflow passage and a return passage, the inflow passage is in communication with the first through hole for driving a low-pressure fluid into the bulging section, and the return passage is in communication with the second through hole for allowing the low-pressure fluid to be discharged from the bulging section, a pressure created by the low-pressure fluid on an outer wall of the tube is P1, a deformation pressure threshold of the tube is P2, and P1<P2; and the high-pressure fluid supply passage is in communication with the interior of the tube for delivering a high-pressure fluid to the interior of the tube, the pressure of the high-pressure fluid on the outer wall of the tube is increased to a first pressure threshold P3, wherein P3>P1+P2, such that the tube starts to expand to the bulging area, and the bulging area gradually decreases, the low-pressure fluid supply circuit stopping the supply of the low-pressure fluid when the tube is bulged to conform to the inner wall of the cavity, the high-pressure fluid supply passage continuing to increase the pressure of the high-pressure fluid on the outer wall of the tube to a second pressure threshold P4, wherein P4>P3, such that the tube completely conforms to the inner wall of the cavity to empty the low-pressure fluid from the bulging area.

6. The forming machine with high internal pressure and low external pressure according to claim 5, wherein the inflow passage comprises a first pump, a first overflow valve and an inflow pipeline, the fluid driving device and the first overflow valve are installed on the inflow pipeline, and the inflow pipeline is in communication with the first through hole; and the return passage comprises a return pipeline and a second overflow valve, the return pipeline is in communication with the second through hole, and the second overflow valve is installed on the return pipeline.

7. The forming machine with high internal pressure and low external pressure according to claim 6, wherein a preset first opening pressure of the first overflow valve is P5, a preset second opening pressure of the second overflow valve is P6, and P5=P6.

8. The forming machine with high internal pressure and low external pressure according to claim 5, wherein the high-pressure fluid supply passage comprises a second pump, a pressure booster, and a high-pressure fluid pipeline, the second pump and the pressure booster are installed on the high-pressure fluid pipeline, and the high-pressure fluid pipeline is in communication with the interior of the tube to be formed.

9. The forming machine with high internal pressure and low external pressure according to claim 8, wherein the piston rod of the second side cylinder is provided with a penetrating hole, a first end of the penetrating hole is positioned on an end face of the piston rod, a second end of the penetrating hole is positioned on a side wall of the piston rod, and the high-pressure fluid pipeline is connected to the second end of the penetrating hole.

10. The forming machine with high internal pressure and low external pressure according to claim 5, wherein the high-pressure fluid and the low-pressure fluid may be one of water, oil, air, and nitrogen.

* * * * *